US005435601A

United States Patent [19]

Casari

[11] Patent Number: 5,435,601

[45] Date of Patent: Jul. 25, 1995

[54] REUSABLE TELECOPIER COVER LETTER

[76] Inventor: Derek A. Casari, 15477 Dickens St., Sherman Oaks, Calif. 91403

[21] Appl. No.: 276,111

[22] Filed: Jul. 15, 1994

[51] Int. Cl.[6] ..... B42D 15/00

[52] U.S. Cl. ..... 283/94; 283/74; 283/75; 283/109

[58] Field of Search ..... 283/94, 98, 99, 107, 283/108, 109, 901, 74–75

[56] References Cited

U.S. PATENT DOCUMENTS 5,085,469 2/1992 Castro ..... 283/100 X
5,184,849 2/1993 Taylor ..... 283/67

FOREIGN PATENT DOCUMENTS 9003277 4/1990 WIPO ..... 283/94

*Primary Examiner*—Willmon Fridie

*Attorney, Agent, or Firm*—Robert J. Schaap

[57] ABSTRACT

A reusable telecopier cover page having an opaque sheet and a laminated or adhered transparent plastic sheet and which is capable of being delivered through the in-feed of a telecopier to an output thereof. A portion of the opaque sheet is removed to provide a window. In one embodiment, a portion of the transparent plastic sheet at the window is provided with an adhesive coating to adhesively hold a calling card or like printed member bearing identification of the sender. The front sheet is also capable of having material written thereon and easily erased therefrom as, for example, by a marking pen or pencil having readily removable ink. In another embodiment, the window is provided with a peripheral flap formed on one of the sheets so as to retentively, but nevertheless removably hold a calling card or other printed member bearing identification of the sender.

12 Claims, 3 Drawing Sheets

REUSABLE TELECOPIER COVER LETTER

BACKGROUND OF THE INVENTION

1. Field of the Invention

This invention relates in general to certain new and useful improvements in telecopier transmission and more particularly, to an improved, reusable telecopier cover letter.

2. Brief Description of the Prior Art

In recent years, telecopiers, or so called "fax" machines, have become widely used as an instant delivery of written communications. This is particularly true in business offices where telecopiers have become one of the customary pieces of office equipment and are frequently used for transmitting messages.

The sender of a telecommunication or fax will frequently, if not always, use a transmittal cover letter to apprise the receive of the identification of the sender. These cover or transmittal letters, or so called "fax cover sheets", may often contain other types of information informing the receiver of the nature of the communication being transmitted, such as the number of pages, the date of the transmission, time of the transmission, etc. In most cases, this cover letter is usually discarded after receipt of the transmission, since it often times is not needed and the receiver only retains the actual communication. Furthermore, the sender has essentially no need for the transmittal or cover letter and as a result, the cover letter is usually discarded by the sender.

The sender may also opt to send the original or so-called "hard copy" of this telecommunication through the mails to the receiver of the faxed transmission. In this event, inclusion of the fax cover sheet is neither necessary nor appropriate and is not usually included with the mailed conforming copy.

As a result of the foregoing, it can be observed that in essentially every telecommunication, at least one sheet of paper is used for transmission and thereafter discarded. After a period of time, the cost of this discarded cover sheet can become quite substantial, not to mention the actual cost in terms of destroyed natural resources to obtain that cover sheet. As a result, there has been a need for some type of reusable fax cover sheet.

One type of reusable fax cover sheet is illustrated and described in PCT International Application No. PCT/GB89/01093 and published under International Publication No. WO 90/03277, dated Apr. 5, 1990. This transmittal cover sheet was comprised of a plurality of separable plies or sheets, including an opaque backing and a plurality of transparent plastic sheets secured to the opaque backing along an upper margin thereof and overlaying the opaque backing. A fax sender's identification was adapted for application to one of the plies or sheets and erasable messages were to be provided on the other of the plies. However, the reusable cover sheet, as taught in this PCT application, was not practicable since it included a large number of overlying sheets and which could readily interfere with transmission through many conventional telecopier machines. In addition, this cover sheet arrangement was also quite expensive to manufacture and hence, was often costly for use as a reusable cover sheet.

The prior art is also replete with numerous embodiments of transparent sheets having information recorded thereon and which is easily removable therefrom. Exemplary of such publications are U.S. Pat. Nos. 4, 973,254, 4,250,640, 5,006,046, 4,757,901, 4,789,124, 4,456,286, 5,024,332, 4,552,382, 3,099,268.

In each of the aforesaid U.S. patents which are representative of transparent plastic sheets having information recordable thereon, there is no device which is effective as a reusable fax cover letter. In particular, there is no cover sheet having means for incorporating pre-printed sender identification and readily removing that identification to enable use by another sender.

OBJECTS OF THE INVENTION

It is, therefore, one of the primary objects of the present invention to provide a reusable telecopier cover letter in which sender identification can be easily incorporated therein and easily removed therefrom.

It is another object of the present invention to provide a telecopier cover letter of the type stated in which a pocket is provided for receiving a pre-printed sender identification and which is capable of being displayed through a transparent window in the cover letter.

It is a further object of the present invention to provide a telecopier cover letter of the type stated which can be manufactured at a relatively low cost and which is highly effective in operation.

It is an additional object of the present invention to provide a reusable telecopier cover letter in which information can be written on a surface thereof and which is easily erasable or removable from that surface for sending a cover letter to another recipient with different information written thereon.

It is still a further object of the present invention to provide a reusable telecopier cover letter of the type stated which is adaptable for use in most, if not essentially all commercially available telecopiers.

It is another salient object of the present invention to provide a reusable telecopier cover letter in which information written thereon can be easily altered or rewritten when necessary or desirable without destroying the fax cover letter.

It is yet a further object of the present invention to provide a reusable telecopier cover letter which may be made in any of a standard number of sheet sizes.

With the above and other objects in view, my invention resides in the novel features of form, construction, arrangement and combination of parts presently described and pointed out in the claims.

BRIEF SUMMARY OF THE INVENTION

A reusable telecopier or fax cover sheet which is capable of having a pre-printed sender identification incorporated therewith and easily removed therefrom so that other sender identification can be used with the cover sheet. Furthermore, this reusable telecopier cover sheet is capable of having information written on the surface thereof for transmission to a particular receiver and erased therefrom so that other information can be written on the cover sheet for transmission to a different receiver or transmission of a different document to the same receiver.

The reusable telecopier cover sheet of the present invention is comprised in one embodiment of a pair of layers or sheets and includes an opaque rear sheet, preferably formed of a paper stock material or a lightweight flexible plastic material. Facewise disposed upon and secured to the rear opaque sheet is a transparent front sheet or ply and which is preferably formed of a plastic sheet material. The plastic front sheet or ply is usually provided with an adhesive material on its rear surface so that the rear sheet will become readily adhered to the front sheet in a sandwiched structure.

The reusable telecopier cover letter is normally formed with a standard paper dimensions such as $8\frac{1}{2}\times 11$ inches or standard A4 size paper, or the like. However, size is not a critical factor and the letter can be formed of essentially any sized plies, so long as the size is accommodatable by most, if not all, conventional, standard telecopiers.

In both embodiments of the present invention, as hereinafter described, a portion of the opaque rear sheet is removed so as to form a window in a portion of the cover letter. Usually, although not necessarily, the window is located in the upper left-hand portion of the cover letter and is sized to accommodate a conventional business card or so-called "calling card." Furthermore, means is provided with that window to retentively, but nevertheless removably hold a calling card or other pre-printed sheet containing identification information with regard to the sender. In this way, the receiver of a faxed communication will immediately know the identification of the sender. The front transparent sheet is also provided with permanent markings, including defined areas to identify with removable print the date of transmission, times of transmission, the number of sheets being transmitted and like information of the type which is normally transmitted with a communication.

In another embodiment of the invention, the rear surface of the front sheet, which covers one side of the window has an adhesive thereon. In this way, a calling card or other sheet can be readily introduced into the window area and immediately adhered to the rear of the transparent front sheet. In this way, the sender identification will appear through the front window. On a transmitted telecopy, the receiver will not be able to determine that the identification was not an integral part of the cover letter.

In another embodiment of the invention, the window is formed so that there is a peripheral flap which extends around the periphery of the window and which is integral with or otherwise secured to the rear sheet or rear ply. This flap, however, is somewhat yieldable so that it can be separated from the rear sheet. In this way, a calling card or other identification sheet can be bent or bowed or slightly to be inserted in the window and under the flap. Accordingly, the flap extending around the periphery of the identification sheet will hold the sheet within the window opening.

The reusable telecopier cover letter of the present invention can be constructed in a variety of configurations and with different modes of construction. However, two of the preferred configurations and modes of construction are hereinafter described in the detailed description and illustrated in the accompanying drawings. It should be understood that this detailed description and the accompanying drawings are only set forth for purposes of illustrating the general principles of the invention and therefore, are not to be taken in a limiting sense.

BRIEF DESCRIPTION OF THE DRAWINGS

Figure 1:
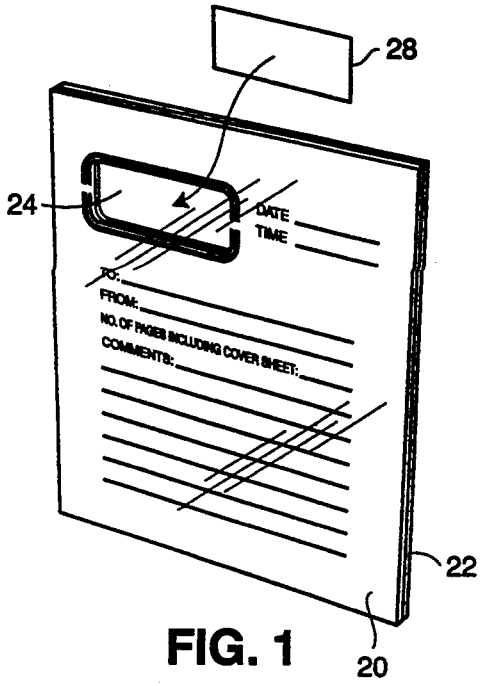
Figure 2:
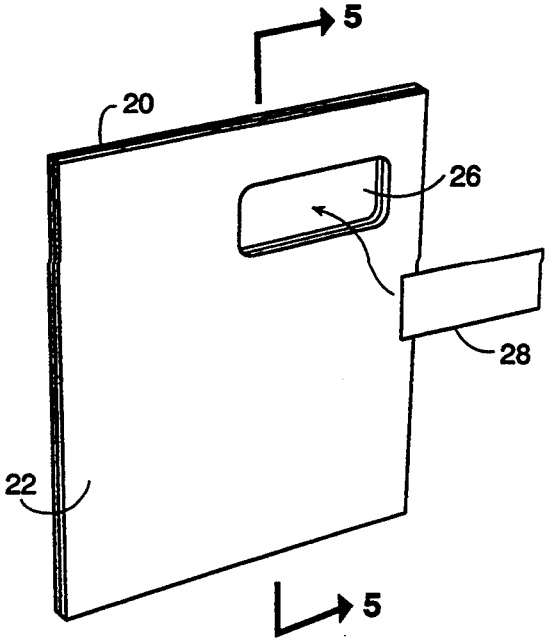
Figure 3:
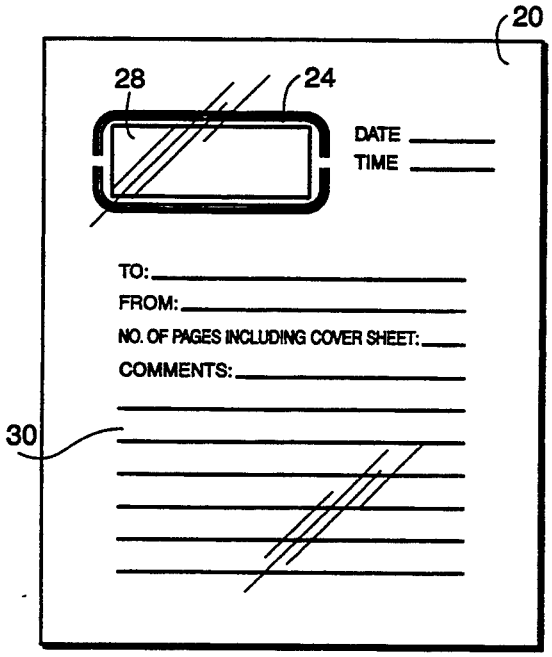
Figure 4:
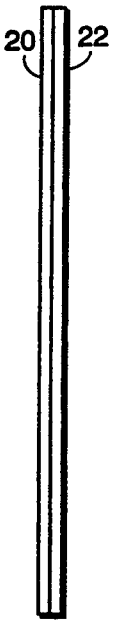
Figure 5:
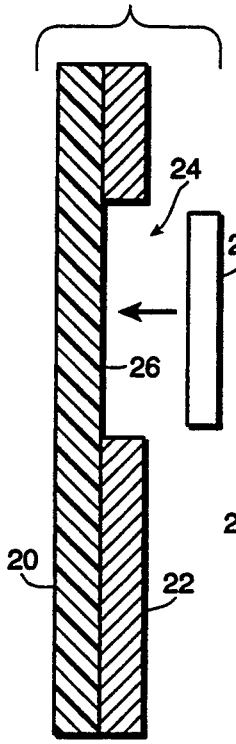
Figure 6:
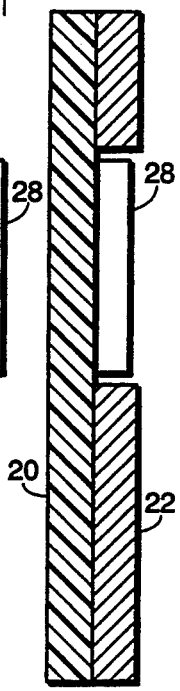
Figure 7:
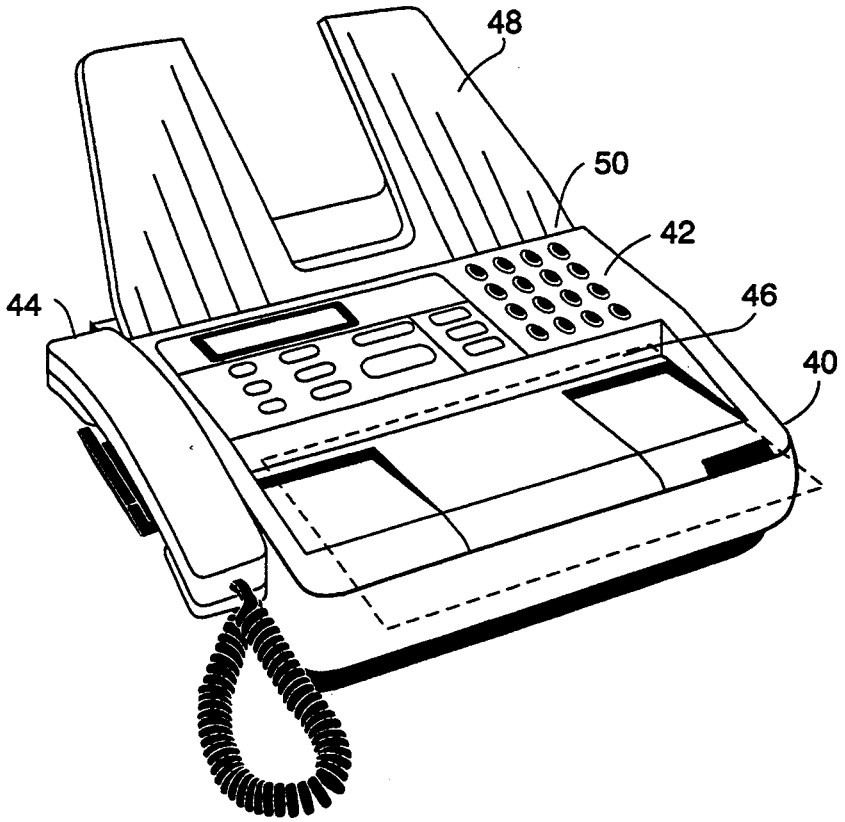
Figure 8:
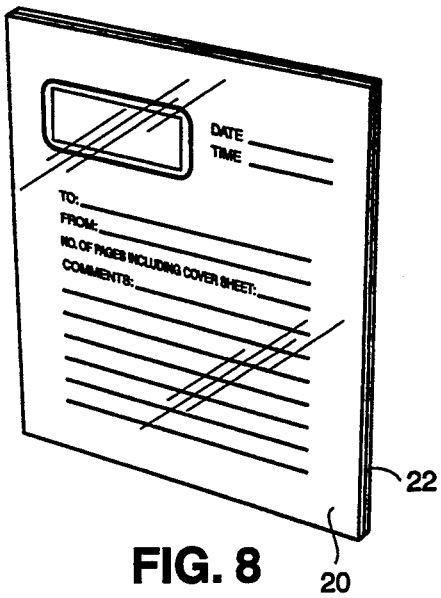
Figure 10:
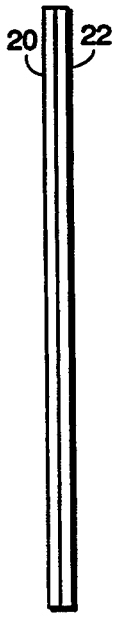
Figure 11:
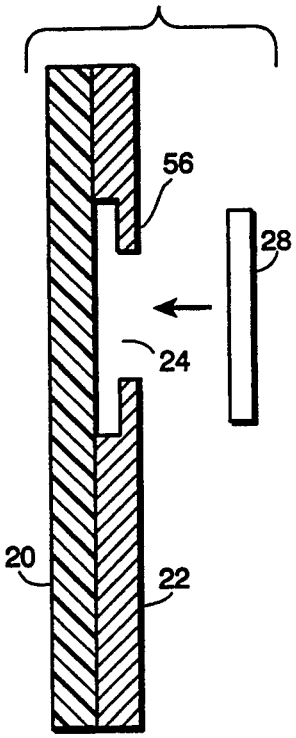
Figure 9:
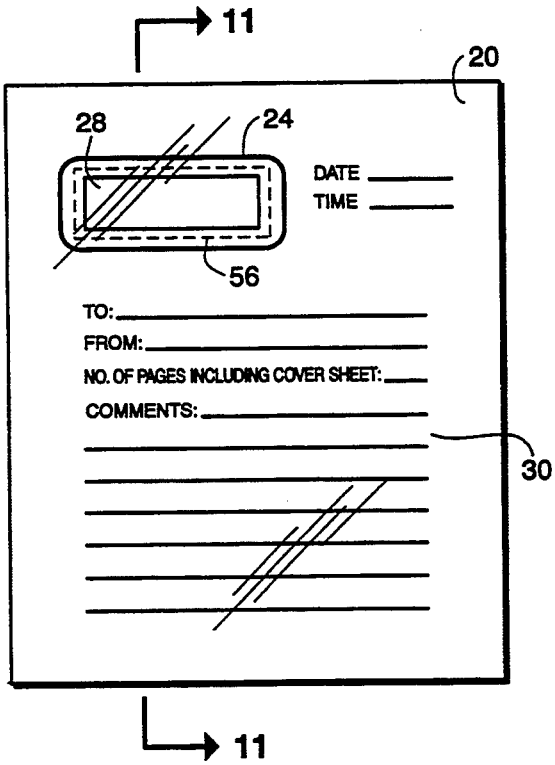
Figure 12:
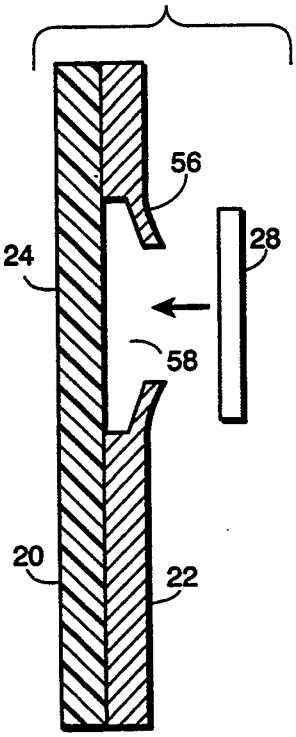
Figure 13:
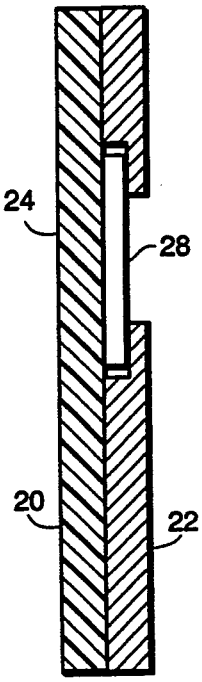

Having thus described the invention in general terms, reference will now be made to the accompanying drawings in which:

FIG. 1 is a front perspective view of a reusable telecopier cover letter constructed in accordance with and embodying the present invention and showing a user identification to be affixed thereto;

FIG. 2 is a rear perspective view of the reusable telecopier cover letter of FIG. 1 and also showing a user identification in a position to be affixed thereto;

FIG. 3 is a front elevational view of a reusable telecopier cover letter constructed in accordance with and embodying the present invention and showing a user identification affixed thereto;

FIG. 4 is a side elevational view of the reusable telecopier cover sheet of the present invention;

FIG. 5 is a vertical sectional view, taken along line 5—5 of FIG. 2 and showing a user identification in a position where it is to be affixed to the window forming part of the cover letter;

FIG. 6 is a vertical sectional view, similar to FIG. 5, and showing the user identification affixed thereto;

FIG. 7 is a perspective view of a conventional telecopier showing a reusable telecopier cover letter of the invention located at the in-feed means thereof;

FIG. 8 is a perspective view of a slightly modified form of reusable telecopier cover letter;

FIG. 9 is a front elevational view of the telecopier cover letter of FIG. 8;

FIG. 10 is a vertical sectional view, taken along line 10—10 of FIG. 9;

FIG. 11 is a vertical sectional view, similar to FIG. 10, and showing a user identification in a position to be affixed to the cover letter;

FIG. 12 is a vertical sectional view, similar to FIGS. 10 and 11, and showing a displacement of a peripheral flap to allow a user identification card to be inserted in the window forming part of the cover letter; and FIG. 13 is a vertical sectional view, similar to FIGS. 10–12, and showing the user identification in a position where it is affixed to the cover letter in the window thereof.

DETAILED DESCRIPTION OF PREFERRED EMBODIMENTS

Referring now in more detail and by reference characters to the drawings which illustrate practical embodiments of the present invention, $C_1$ designates a reusable telecopier cover letter and which is comprised of a first ply or sheet 20 and a facewise disposed sandwiched second ply or sheet 22. In the embodiment as illustrated, the first ply or sheet 22 is a front ply or sheet and the second ply or sheet constitutes a rear ply. Both sheets, however, have peripheral margins which are registered with one another and together operate as a single sheet, to function as a single sheet reusable telecopier cover letter.

The first and second sheets 20 and 22 may be secured by any conventional means as, for example, by laminating or the like. However, in a preferred embodiment of the invention, as described herein, the first sheet 20 is a transparent plastic sheet having an adhesive coating on its rear surface. The second sheet 22 is preferably an opaque sheet, such that when the two are secured together, in the manner as illustrated in FIGS. 1–6 of the drawings, the entire cover letter will appear as an opaque cover letter. Preferably, the second sheet is of a white color so that the cover letter itself is white. In this respect, the second sheet could be formed of conventional paperstock material.

The first sheet 20 is preferably formed of a transparent polyethylene material. However, any of a number of known plastic materials may be used to form the sheet.

Moreover, coating of the sheet with an adhesive is performed in a conventional manner.

The second sheet has a portion thereof removed, as shown in FIG. 5, in order to form a window 24 appearing through the first sheet 20. In actuality, the window 24 is formed by a removed section of the second sheet 22, as best shown in FIG. 5. However, when a portion of this second sheet 22 is removed to define the window 24, the rear surface 26 of the first sheet 20 has an adhesive coating presented rearwardly thereon. In this way, a conventional calling card or like substrate 28 may be affixed to the rear surface 26 of the window 24.

The calling card 28 is preferably a conventional type of paperstock calling card containing identification information of a particular individual or organization thereon. In this way, when the calling card 28 is affixed to the window 24, the cover letter will appear as though it has user identification information actually imprinted on the surface thereof. However, the calling card, or other substrate, can be removed so that different user identification can also be inserted therein.

The front face of the first sheet 20 is also provided with additional permanently printed information and selected areas 30 for a user to write additional information. For example, the front face may contain preprinted information, such as a the word "date" with a line for the user to write in the date with a marking pen having removable ink. In like manner, other information can be permanently printed as, for example, a place to indicate the number of sheets being transmitted, an area for the user to write instructions to the receiver, etc.

The information written on the front sheet 20 by the sender is preferably performed with a marking pen or pencil (not shown), that is, with an ink or marking material which is readily removable from the front sheet. In this respect, the front sheet 20 may be provided with a coating on its front surface to enable an easy erasing of the material marked thereon. Essentially, any pen having a readily erasable and removable marking ink which enables erasing by merely wiping the surface of the sheet may be used. In this way, the reusable telecopier cover letter may be used repeatedly for functioning as a cover letter for different transmissions.

FIG. 7 illustrates a conventional telecopier or fax machine having a housing 40 with a key pad 42 for introducing a telephone number, a handset and an infeed means, such as a feed slot 46. At its opposite end, the housing 40 is provided with an outfeed (not shown) leading directly to a retaining tray 48. The conventional telecopier may be provided with a display 50 for displaying information of the type being introduced therein through the key pad 42.

The infeed means 46 has a size sufficient to accommodate the individual sheets of a transmission and particularly to accommodate the reusable telecopier cover letter. In this respect, the infeed slot 46 has a width which is greater than the width of the telecopier cover letter. In like manner, it has an overall height sufficient to at least accommodate the thickness of the telecopier cover letter.

The conventional telecopier will have a transporting means which is designed to receive a document at the infeed means and transport the same through a scanning path in the telecopier. Further, a scanning means will scan information on the document for purposes of transmitting the same. This transporting means and scanning means, as well as the infeed means, is conventional and found in various forms in most conventionally available telecopiers.

The telecopier cover letter will pass through the telecopier, much in the same manner as a conventional sheet so that information thereon may be retrieved, much in the same manner as information scanned on a sheet. In this respect, the receiver will have a cover letter printed at the receiver's end which appears as though the cover letter constituted a single sheet of paper with identification information permanently written on that sheet of paper.

FIGS. 8–13 illustrate a slightly modified form of telecopier cover letter. In this case, FIG. 8 illustrates an embodiment C2 which includes a front sheet 20 and a rear sheet 22, much in the same manner as secured together as the sheets 20 and 22 in the cover letter $C_1$. However, in the embodiment of the invention, as illustrated in FIGS. 8–13, an overhanging peripheral flap 56, which is integral with the rear sheet 22, overlies a peripheral portion of the window 24, as best illustrated in FIGS. 11–13 of the drawings.

A user identification substrate, such as a calling card 28, can be bowed slightly and the peripheral flap 56 extended outwardly from the front sheet 24 by slightly bowing the cover letter $C_2$ and squeezing the identification substrate 28 into the space 58 formed by the flap 56 on the rear sheet 22. Thereafter, the peripheral flap 56 will elastically close to its normal position, as shown in FIGS. 11 and 13. Thus, the user identification card, or other substrate 28, is then retentively held against the rear surface of the window 24.

Thus, there has been illustrated and described a unique and novel reusable telecopier cover letter which allows user identification to be easily applied to and removed therefrom and which thereby fulfills all of the objects and advantages which have been sought. It should be understood that many changes, modifications, variations and other uses and applications will become apparent to those skilled in the art after considering this specification and the accompanying drawings Therefore, any and all such changes, modifications, variations and other uses and applications which do not depart from the spirit and scope of the invention are deemed to be covered by the invention which is limited only by the following claims.

Having thus described the invention, what I desire to claim and secure by Letters Patent is:

1. A reusable telecopier cover letter to be used with a telecopier transmission of other data sheets and which contains user identification information removably affixed thereto, said reusable telecopier cover letter comprising:

a) a first flexible and foldable transparent sheet having a size and shape such that it is readily accommodatable in a telecopier;

b) a second sheet having a size and shape so that it is readily accommodatable in a telecopier and being secured to a rear face of the first sheet in a sandwiched structure relationship;

c) informational material permanently imprinted on a front face of said front sheet and providing areas for data to be removably written on the front face of said front sheet and which data may be relevant to a transmission of the cover letter and one or more accompanying documents to be telecopied therewith;

d) a window formed in a removed area of said rear sheet and being sized to receive a user identification substrate such that user identification will appear through the transparent front sheet at the window portion of the cover letter; and e) means associated with said window to retentively, but nevertheless, removably hold said user identification substrate in relationship to said front sheet.

2. The reusable telecopier cover letter of claim 1 further characterized in that said rear sheet is opaque.

3. The reusable telecopier cover letter of claim 2 further characterized in that said rear sheet is marginally registered with said front sheet.

4. The reusable telecopier cover letter of claim 1 further characterized in that said front sheet is retentively held to said rear sheet by an adhesive type surface existing between the front sheet and the rear sheet.

5. The reusable telecopier cover letter of claim 1 further characterized in that the means for retentively, but releasibly holding the user identification substrate is an adhesive film on the rear surface of said front sheet.

6. The reusable telecopier cover letter of claim 1 further characterized in that the means to retentively, but removably hold the user identification substrate is a peripheral flap extending around the window, but which is partially displaceable to allow the user identification substrate to be inserted therein adjacent the window.

7. In combination with a facsimile machine having (i) means for transporting written documents therethrough and scanning information on documents and (ii) infeed means for receiving the documents to enable scanning of the information written thereon, said infeed means having (iii) an inlet opening with a width sized to receive information-bearing sheets to be transported past a scanning means; a reusable fax cover letter having a leading edge and a trailing edge, the reusable fax cover letter having a width less than the width of the inlet opening of said infeed means, such that the fax letter is inserted into the infeed means and carried by a transporting means in the telecopier past a scanning means for scanning the information thereon; said reusable fax cover letter comprising a pair of facewise disposed sheets with one of said sheets being transparent and the other of said sheets being opaque, a window formed in said opaque sheet so that a user identification can be inserted at the window and retentively held therein such that when the cover letter is transmitted via facsimile, the user's reproduced copy of the cover letter will appear as though the identification information of the sender was an integral part of the cover letter.

8. The combination of claim 7 further characterized in that said front sheet and said rear sheet are adhered to one another and are marginally registered with one another.

9. The combination of claim 7 further characterized in that means is provided to retentively, but nevertheless removably hold a user identification substrate at the window.

10. The combination of claim 9 further characterized in that the means to retentively, but removably hold the user identification substrate is an adhesive coating at the window.

11. The combination of claim 9 further characterized in that the means to retentively but removably hold the user identification substrate at the window is a peripheral flap formed integral with said second sheet and extending around the window thereof.

12. The combination of claim 8 further characterized in that the face sheet has a surface for erasably writing on the outer face of said first sheet, along with an erasable means for erasing information which is written on the front face of the first sheet.

* * * * *